US012729588B1

(12) United States Patent
Bajunaid et al.

(10) Patent No.: US 12,729,588 B1
(45) Date of Patent: Sep. 8, 2026

(54) JETTING SYSTEM FOR DRILLING OPERATIONS

(71) Applicant: SAUDI ARABIAN OIL COMPANY, Dhahran (SA)

(72) Inventors: Muaath Salem Bajunaid, Dhahran (SA); Omar M. Alhamid, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 19/264,292

(22) Filed: Jul. 9, 2025

(51) Int. Cl.

| | |
|---|---|
| ***E21B 7/18*** | (2006.01) |
| ***E21B 7/04*** | (2006.01) |
| ***E21B 10/18*** | (2006.01) |
| ***E21B 10/38*** | (2006.01) |
| ***E21B 10/43*** | (2006.01) |
| ***E21B 10/60*** | (2006.01) |
| ***E21B 21/08*** | (2006.01) |

(52) U.S. Cl.
CPC ..... *E21B 7/18* (2013.01); *E21B 7/046* (2013.01); *E21B 10/18* (2013.01); *E21B 10/38* (2013.01); *E21B 10/60* (2013.01); *E21B 21/08* (2013.01); *E21B 10/43* (2013.01)

(58) Field of Classification Search
CPC . E21B 7/18; E21B 7/046; E21B 10/18; E21B 10/38; E21B 10/60; E21B 21/08; E21B 10/43
See application file for complete search history.

(56) References Cited

U.S. PATENT DOCUMENTS

| | | | | |
|---|---|---|---|---|
| 4,119,160 | A | 10/1978 | Summers et al. | |
| 4,372,402 | A * | 2/1983 | Trevino, Jr. | E21B 10/18 175/318 |
| 5,775,443 | A | 7/1998 | Lott | |
| 9,115,541 | B2 | 8/2015 | Li et al. | |
| 10,920,500 | B1 * | 2/2021 | Dunbar | E21B 41/0078 |
| 2013/0161102 | A1 * | 6/2013 | Zhou | E21B 10/60 175/263 |
| 2022/0065046 | A1 * | 3/2022 | Berger | E21B 25/14 |

* cited by examiner

*Primary Examiner* — Neel Girish Patel

(74) *Attorney, Agent, or Firm* — Osha Bergman Watanabe & Burton LLP

(57) ABSTRACT

A system includes a drill bit, nozzle, at least two mechanical rods, and at least one hinge. The drill bit has a drill bit bore and is configured to drill a borehole. The nozzle is disposed within the drill bit bore and has a nozzle bore configured to convey a fluid. The at least two mechanical rods are disposed along a surface of the nozzle bore. The proximal mechanical rod among the at least two mechanical rods is fixed to the surface. The distal mechanical rod and the nozzle bore form a nozzle aperture. The at least one hinge is configured to connect the at least two mechanical rods together longitudinally. The distal mechanical rod is configured to rotate around the at least one hinge in response to the fluid to adjust the nozzle aperture.

19 Claims, 10 Drawing Sheets

JETTING SYSTEM FOR DRILLING OPERATIONS

BACKGROUND

Conventional borehole drilling and workover operations may suffer from inefficiencies that, in turn, cause slow drilling rates (i.e., rates of penetration). One inefficiency is a plugged nozzle that is disposed within the drill bit drilling the borehole. The traditional practice for replacing the nozzle, whether plugged and/or of an inadequate size, is to retrieve the drill bit and nozzle uphole out of the borehole, replace the nozzle at the surface, and return the drill bit and replaced nozzle downhole within the borehole to continue drilling. Accordingly, this practice is time consuming and increases operational downtime by requiring "trips" in and out of the borehole. Accordingly, a need exists to reduce operational downtime during borehole drilling operations.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments relate to a system. The system includes a drill bit, nozzle, at least two mechanical rods, and at least one hinge. The drill bit has a drill bit bore and is configured to drill a borehole. The nozzle is disposed within the drill bit bore and has a nozzle bore configured to convey a fluid. The at least two mechanical rods are disposed along a surface of the nozzle bore. The first mechanical rod among the at least two mechanical rods is fixed to the surface. The second mechanical rod and the nozzle bore form a nozzle aperture. The at least one hinge is configured to connect the at least two mechanical rods together longitudinally. The second mechanical rod is configured to rotate around the at least one hinge in response to the fluid to adjust the nozzle aperture.

In general, in another aspect, embodiments relate to a method. The method includes drilling, using a system, a borehole at a first rate of penetration. The system includes a drill bit, nozzle, at least two mechanical rods, and at least one hinge. The drill bit has a drill bit bore and is configured to drill a borehole. The nozzle is disposed within the drill bit bore and has a nozzle bore. The at least two mechanical rods are disposed along a surface of the nozzle bore. The first mechanical rod among the at least two mechanical rods is fixed to the surface. The second mechanical rod and the nozzle bore form a nozzle aperture. The at least one hinge is configured to connect the at least two mechanical rods together longitudinally. The method further includes pumping, using a drilling fluid system and as prescribed by a control system, a fluid at a first flow rate through the nozzle bore and out the nozzle aperture and rotating, in response to the fluid, the second mechanical rod around the at least one hinge. The method still further includes adjusting, by rotation of the second mechanical rod, the nozzle aperture.

Other aspects and advantages of the claimed subject matter will be apparent from the following description and the appended claims.

DETAILED DESCRIPTION

Figure 1:
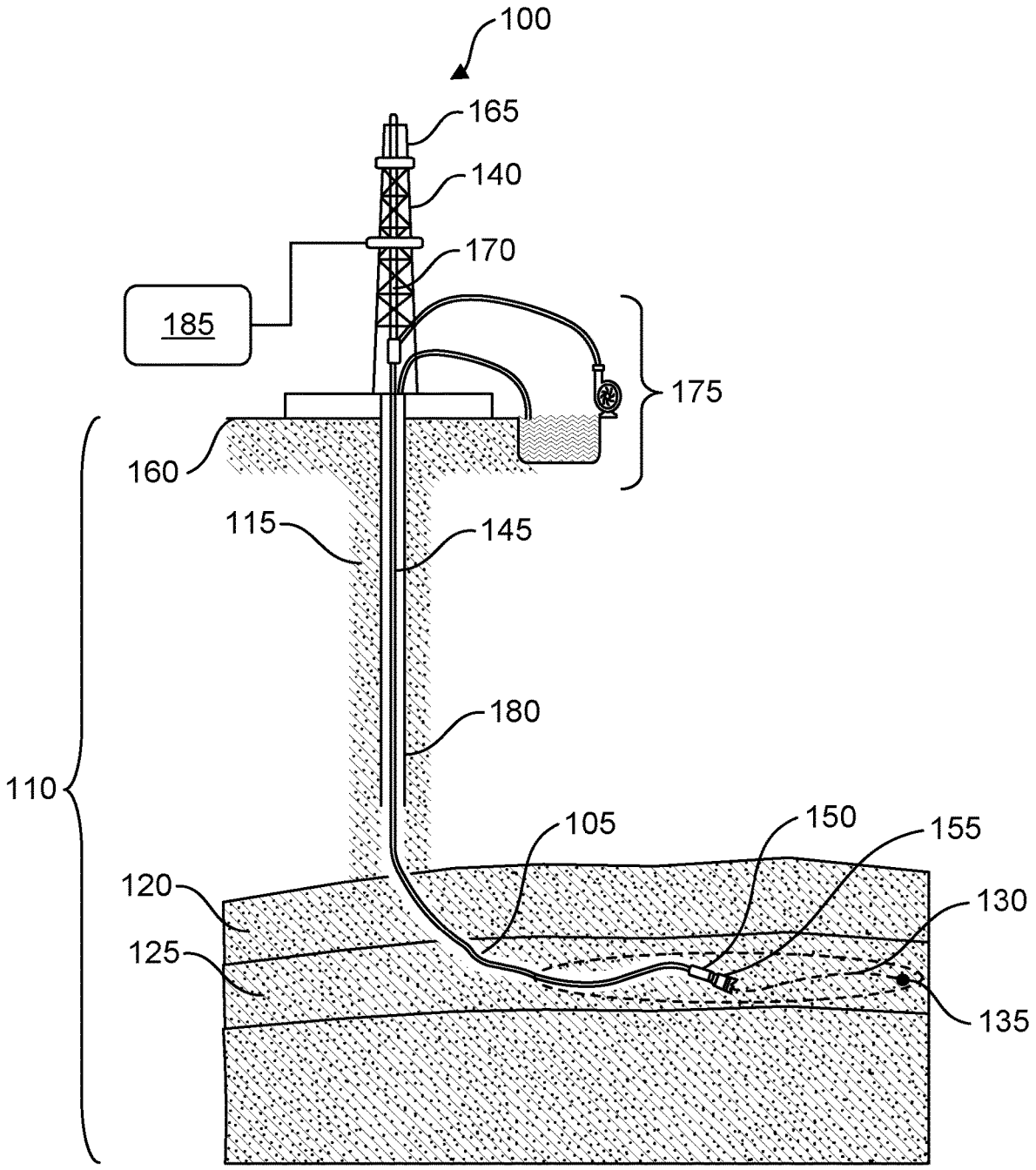
FIG. 1 illustrates a drilling system in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before," "after," "single," and other such terminology. Rather, the use of ordinal numbers is to distinguish between the elements. By way of an example, a first element is distinct from a second element, and the first element may encompass more than one element and succeed (or precede) the second element in an ordering of elements.

In the following description of FIGS. 1-6, any component described regarding a figure, in various embodiments disclosed herein, may be equivalent to one or more like-named components described regarding any other figure. For brevity, descriptions of these components will not be repeated regarding each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described regarding a corresponding like-named component in any other figure.

It is to be understood that the singular forms "a," "an," and "the" include plural referents unless the context clearly dictates otherwise. Thus, for example, reference to a "mechanical rod" includes reference to one or more of such rods.

Terms such as "approximately," "substantially," etc., mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

It is to be understood that one or more of the steps shown in the flowchart may be omitted, repeated, and/or performed in a different order than the order shown. Accordingly, the scope disclosed herein should not be considered limited to the specific arrangement of steps shown in the flowchart.

Systems and methods disclosed herein are directed to a jetting system with adjustable nozzle (hereinafter also simply "jetting system" or "system"). The jetting system may be used in high-pressure drilling and/or workover operations. The system includes a nozzle and at least two mechanical rods connected using at least one hinge. The at least two mechanical rods are disposed along a surface of a nozzle bore of the nozzle. The first mechanical rod among the at least two mechanical rods is fixed to the surface of the nozzle bore. One or more mechanical rods distal to the first mechanical rod are free to rotate around one or more hinges. Rotation of the one or more mechanical rods adjusts a nozzle aperture (i.e., nozzle size) of the nozzle. In some embodiments, the system further includes a drill bit configured to drill a borehole. The nozzle with the at least two mechanical rods may be disposed within a drill bit bore of the drill bit.

Because of the rotatability of the one or more mechanical rods, the nozzle aperture is adjustable or adaptable. This adjustability offers several advantages. One advantage is that the adjustable nozzle allows for better control of the pressure and flow rate of fluid being conveyed through the nozzle bore during drilling or workover operations compared to a traditional nozzle. Accordingly, the adjustable nozzle increases or decreases the rate of penetration of drilling as needed. Another advantage is that the adjustable nozzle may reduce operational downtime associated with unplugging a traditional nozzle or switching out the traditional nozzle for a different-sized traditional nozzle at the surface above the borehole, which requires additional trips uphole and downhole. In contrast, the disclosed methods and systems do not require additional trips uphole or downhole to adjust the size of or unplug the adjustable nozzle. Avoiding the need for multiple traditional nozzle sizes may also reduce cost and increase drilling flexibility. Accordingly, the system improves borehole drilling and/or workover operations.

Though the disclosed systems and methods are described relative to drilling a borehole within a formation. The disclosed systems and methods may alternatively be used to drill any hole within any medium where drilling fluid (hereinafter also simply "fluid") is conveyed through a nozzle bore of a nozzle during drilling without departing from the scope of the disclosure. One example includes stone cutting operations.

To present the jetting system with adjustable nozzle, the greater drilling system that the jetting system operates within is first presented.

FIG. 1 illustrates a drilling system 100 performing a borehole drilling operation in accordance with one or more embodiments. The drilling system 100 is configured to drill a borehole 105 within a formation 110. The formation 110 may include layers of overburden rock 115, including cap rock 120, and a reservoir 125, such as a hydrocarbon reservoir or water reservoir.

The drilling system 100 may be configured to drill the borehole 105 within the formation 110 guided by a borehole drilling plan that includes a borehole path 130. In some embodiments, the borehole drilling plan may be designed such that the borehole path 130 penetrates a drilling target 135 within the formation 110, such as within the reservoir 125.

Although the drilling system 100 shown in FIG. 1 is configured to drill the borehole 105 on land, the drilling system 100 may be configured to drill the borehole 105 below water and, accordingly, be a marine borehole drilling system. Further, although the drilling system 100 shown in FIG. 1 is used to drill a new borehole 105, the borehole 105 being drilled may be a sidetrack borehole or offset borehole. As such, the example of the drilling system 100 shown in FIG. 1 is not meant to limit the present disclosure.

The borehole 105 may be drilled using a drill rig situated on a land drill site or an offshore platform, such as a jack-up rig, semi-submersible rig, or drill ship. The drill rig may be equipped with a hoisting system, such as a derrick 140 that raises or lowers a drillstring 145 equipped with a drill collar and other tools required to drill the borehole 105. The drillstring 145 may include one or more drill pipes connected to form conduit. A bottom hole assembly 150 (BHA) may be disposed at the distal end of the drillstring 145. A drill bit 155 may be disposed at a distal end of the BHA 150 and configured to cut into the formation 110 using rotational and/or percussive motion.

In some embodiments, the BHA 150 may further include measurement tools, such as measurement-while-drilling (MWD) tools and logging-while-drilling (LWD) tools. MWD tools may include sensors and hardware to measure downhole drilling parameters, such as the azimuth and inclination of the drill bit 155, weight-on-bit, torque, drill bit rotational speed (RPM), flow rate of drilling fluid systems (GPM), rate of penetration of the drilling operation (ROP), etc. The LWD tools may include sensors, such as resistivity, gamma ray, and neutron density sensors configured to characterize the rock 115 surrounding the borehole 105. Both MWD and LWD measurements may be transmitted to the surface of the Earth 160 using any suitable telemetry system known in the art, such as mud-pulse telemetry or wirelines. The drilling system 100 may receive data from one or more sensors arranged to measure controllable parameters of the drilling operation.

To commence drilling or "spudding in" the borehole 105, the hoisting system lowers the drillstring 145 suspended from the derrick 140 of the drill rig towards the planned surface location of the borehole 105. An engine, such as a diesel engine, may be configured to supply power to the top drive 165 to rotate the drillstring 145 via the drive shaft 170. The weight of the drillstring 145 combined with the motion of the drill bit 155 enables the drill bit 155 to drill the borehole 105.

While drilling, a drilling fluid system 175 (colloquially a "mud pump") may pump fluid (colloquially "mud") from a fluid tank located on the surface of the Earth 160 through the drillstring 145. The fluid serves various purposes, including pressure equalization, removal of rock cuttings, cleaning of the BHA 150 or portions thereof, and the cooling and lubrication of the drill bit 155.

The near-surface rock 115 of the formation 110 is typically made up of loose or soft sediment rock, so large diameter casing 180 (e.g., "base pipe" or "conductor casing") is often put in place while drilling to stabilize and isolate the borehole 105. At the top of the casing 180 is the wellhead (not shown), which is configured to provide pressure control through a series of spools, valves, and adapters. Once near-surface drilling has begun, the drilling fluid may be used to force the base pipe into place using a pumping system (not shown) until the wellhead is situated just above the surface of the Earth 160. Drilling may continue without any casing 180 once deeper or more compact rock 115 is reached.

At planned depth intervals, drilling may be paused and the drillstring 145 withdrawn from the borehole 105. Sections of casing 180 may be connected, inserted, and cemented into the borehole 105. Casing 180 may be cemented in place by pumping cement and drilling fluid, separated by a "cementing plug," from the surface of the Earth 160 through the drillstring 145. The cementing plug and drilling fluid force the cement through the drillstring 145 and into the annular space between the casing 180 and the wall of the borehole 105. Once the cement cures, drilling may recommence. The drilling process is often performed in several stages. Therefore, the drilling and casing cycle may be repeated more than once, depending on the depth of the borehole 105 and the pressure on the walls of the borehole 105 from surrounding rock 115. As the borehole 105 becomes deeper, both successively smaller drill bits 155, nozzles, drilling tools, and/or casing 180 may be used. Drilling deviated or horizontal wells may require specialized drill bits, nozzles, and/or drill assemblies.

Due to the high pressures experienced by deep boreholes, a blowout preventer (BOP) may be installed at the wellhead to protect the drill rig and environment from unplanned oil or gas releases.

The drilling system 100 may communicate with other systems associated with the environment, such as a control system 185. The drilling system 100 may control at least a portion of the drilling operation, some of which may be based on drilling parameters and/or drilling objectives, by providing controls to various components of the drilling system 100 as prescribed by the control system 185. Drilling may be considered complete when the drilling target 135 within the reservoir 125 is reached or the presence of subterranean fluid (e.g., hydrocarbons and water) is established.

Though FIG. 1 describes drilling a borehole 105 to penetrate a reservoir 125 within a formation 110, the drilling system 100 may be configured for other drilling applications without departing from the scope of the disclosure. Other borehole drilling applications may include, without limitation, oceanic and continental exploration drilling, geothermal drilling, and water-well drilling.

Figure 2:
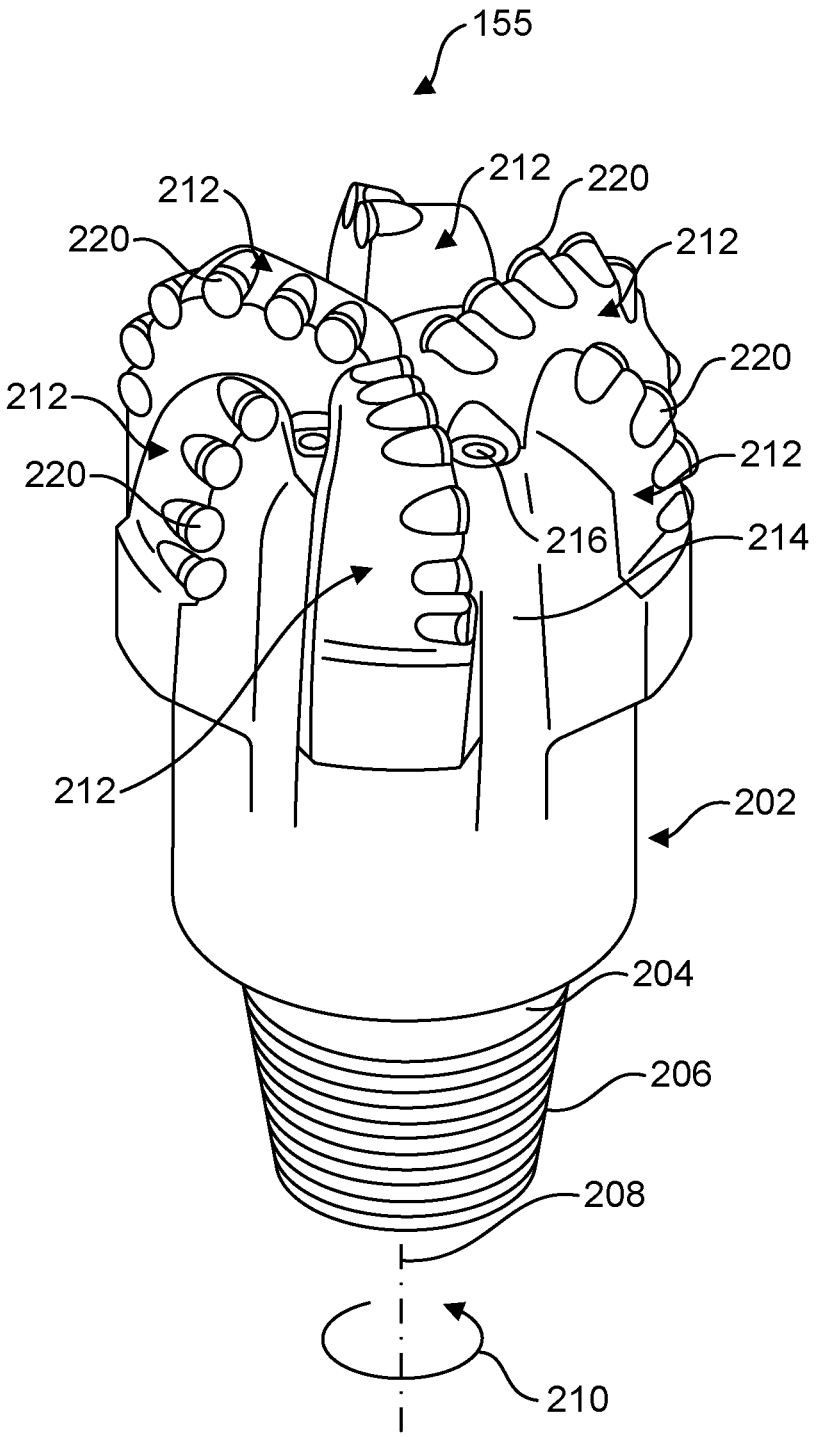
FIG. 2 illustrates a drill bit in accordance with one or more embodiments.

FIG. 2 illustrates a drill bit 155 in accordance with one or more embodiments. FIG. 2 specifically illustrates a polycrystalline diamond compact (PDC) bit though any drill bit 155 known to a person of ordinary skill in the art may be used as a part of the disclosed system and should not be considered limiting. The drill bit 155 has a bit body 202 rigidly connected to a central shank 204 that terminates in a threaded connection 206. The threaded connection 206 threads to the drillstring 145. The drill bit 155 via the drillstring 145 rotates around a central axis 208 as represented by arrow 210.

The cutting structure on the drill bit 155 includes six angularly-spaced blades 212. The angularly-spaced blades 212 may be identical to each other or may be of different blade types and/or designs. Each angularly-spaced blade 212 extends from the bit body 202 radially outward from the axis 208. The angularly-spaced blades 212 are separated by channels 214 (colloquially "junk slots" or "flow courses"). The channels 214 convey fluid supplied by the drillstring 145 through apertures, which may be referred to as traditional nozzle apertures 216. In turn, the fluid cools the PDC cutters 220 and carries rock cuttings away from the face of the drill bit 155 uphole. Those skilled in the art will appreciate that while FIG. 2 shows six angularly-spaced blades 212, any suitable number of blades 212 may be used in the cutting structure of the drill bit 155 and should not be limiting.

Figure 3:
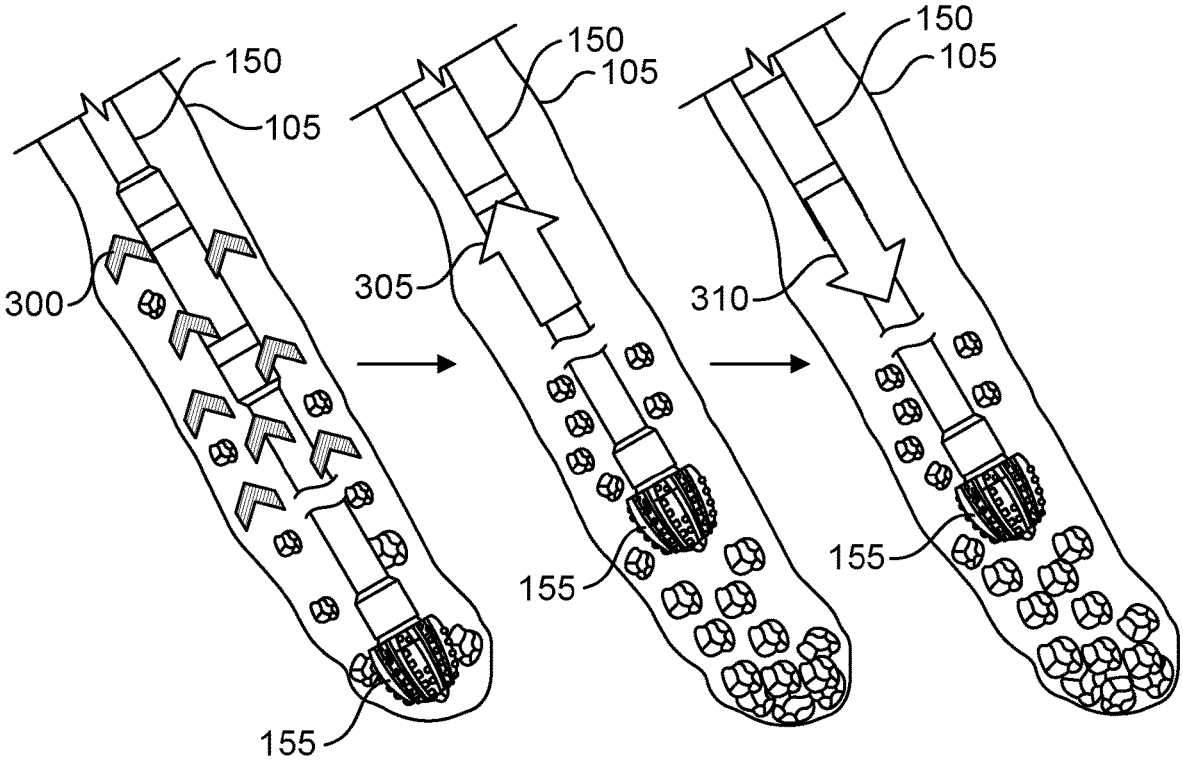
FIG. 3 illustrates a traditional drilling operation.

FIG. 3 illustrates a traditional drilling operation. Each instance of drilling in FIG. 3, illustrates the drill bit 155 attached to the BHA 150, where the drill bit 155 is drilling the borehole 105 through the formation 110. During drilling, fluid is conveyed through the drillstring 145, BHA 150, and drill bit 155 where the fluid then contacts the borehole 105 and travels uphole as shown by the arrows 300. This circulation of drilling fluid continues as drilling continues.

If the traditional nozzle within the drill bit 155 gets plugged and/or a different sized traditional nozzle is needed to continue drilling the borehole 105 based on the drilling parameters, the drill bit 155 is retrieved uphole to the surface of the Earth 160 as shown by arrow 305. That is, colloquially, a "trip" out of the borehole 105 is performed. At the surface of the Earth 160, the traditional nozzle is changed out for a traditional nozzle of a different size and/or is unplugged. The drill bit 155 with the different-sized and/or unplugged nozzle is then redisposed or "run" back downhole in another "trip" such that drilling may continue as shown by arrow 310.

Figure 4A:
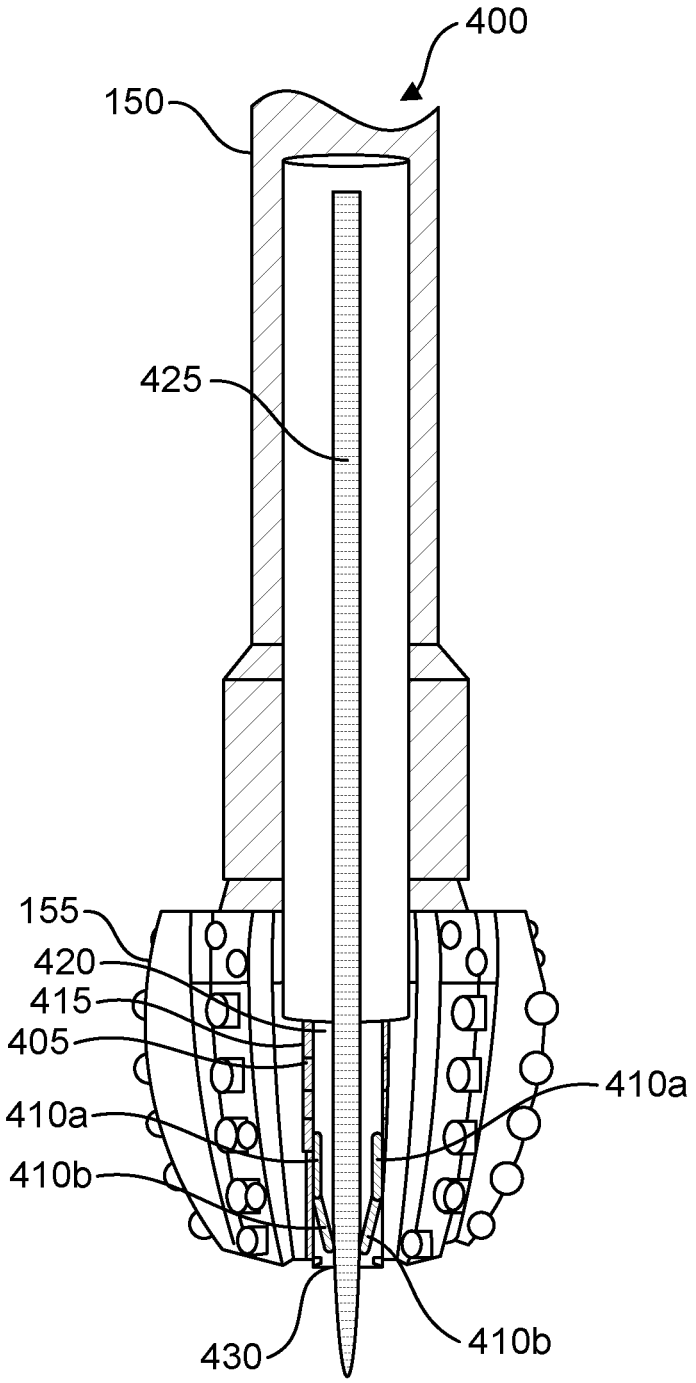
FIGS. 4A-4C illustrate a system in accordance with one or more embodiments.

FIG. 4A illustrates a system 400 in accordance with one or more embodiments. The system 400 includes a nozzle 405, two mechanical rods 410*a, b*, and one hinge (not shown). The system 400 may further include a drill bit 155. As previously described, the drill bit 155 is configured to drill a borehole 105.

The drill bit 155 has a drill bit bore 415. Though illustrated as the drill bit 155 having one central drill bit bore 415, the drill bit 155 may have multiple drill bit bores 415 in a radial pattern without departing from the scope of the disclosure. The nozzle 405 is disposed within the drill bit bore 415 of the drill bit 155. If there are multiple drill bit bores 415, one nozzle 405 may be disposed within each drill bit bore 415 though not necessarily disposed in all the drill bit bores 415. The nozzle 405 may be made of any durable material able to withstand high pressures of fluid, such as stainless steel.

The nozzle 405 has a nozzle bore 420. The nozzle bore 420 is configured to convey a fluid 425.

Two mechanical rods 410*a, b* are connected longitudinally by the one hinge. The two mechanical rods 410*a, b* and hinge are disposed along a surface of the nozzle bore 420. FIG. 4A specifically illustrates two sets of two mechanical rods 410*a, b* disposed along the surface of the nozzle bore 420 opposite one another. Accordingly, any number of sets of at least two mechanical rods 410*a, b* may be disposed along the surface of the nozzle bore 420, such as in a radial pattern.

There is a first mechanical rod 410*a* and a second mechanical rod 410*b* among the two mechanical rods 410*a, b*. The first mechanical rod 410*a* is fixed to the surface of the nozzle bore 420 using any means known to a person of ordinary skill in the art. For example, the fixing means may be a screw or nut-and-bolt system. The second mechanical rod 410*b* is free to rotate around the hinge relative to the fixed first mechanical rod 410*a*.

A distal end of the nozzle bore 420 forms a nozzle aperture 430. The second mechanical rod 410*b* controls the size of the nozzle aperture 430. Accordingly, the nozzle bore 420 and second mechanical rod 410*b* form the nozzle aperture 430. Internal rotation of the second mechanical rod 410*b* decreases (i.e., retracts) the size of the nozzle aperture 430. External rotation of the second mechanical rod 410*b* increases (i.e., extends) the nozzle aperture 430.

FIG. 4A further illustrates the fluid 425 conveying or flowing through the nozzle bore 420 at a first flow rate. Due to the fluid 425 conveying at the first flow rate through the nozzle bore 420, the second mechanical rod 410*b* is internally rotated relative to the first mechanical rod 410*a* to decrease or reduce the size of the nozzle aperture 430.

Figure 4B:
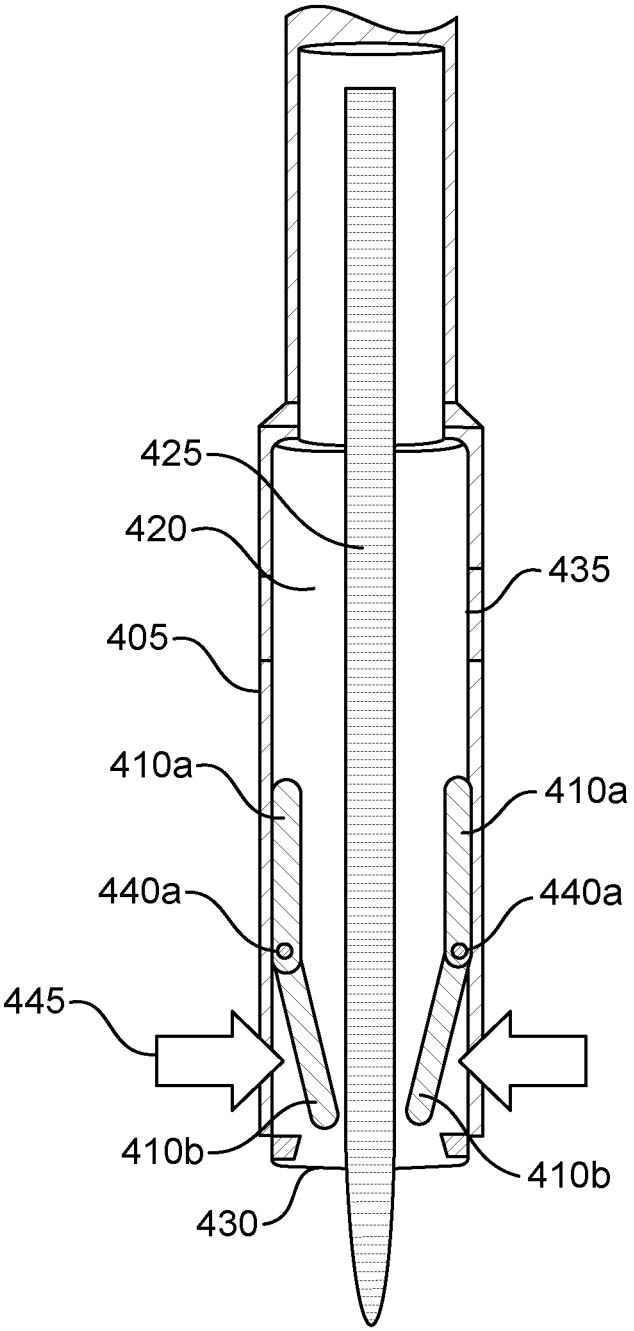

FIG. 4B illustrates the nozzle 405 and two mechanical rods 410*a, b* as shown in FIG. 4A in accordance with one or more embodiments. FIG. 4B clearly shows the nozzle 405, nozzle bore 420, surface 435 of the nozzle bore 420, and nozzle aperture 430 as well as the two mechanical rods 410*a, b* and one hinge 440*a*. Though each of the two mechanical rods 410*a, b* is illustrated with a specific aspect ratio (i.e., length versus width), each of the two mechanical rod 410*a, b* may have any aspect ratio without departing from the scope of the disclosure.

FIG. 4B further illustrates the fluid 425 conveying through the nozzle bore 420 at the first flow rate. Due to the flow of fluid 425 at the first flow rate, the second mechanical rod 410*b* is internally rotated to decrease or reduce the size of the nozzle aperture 430 as shown by the arrows 445.

Figure 4C:
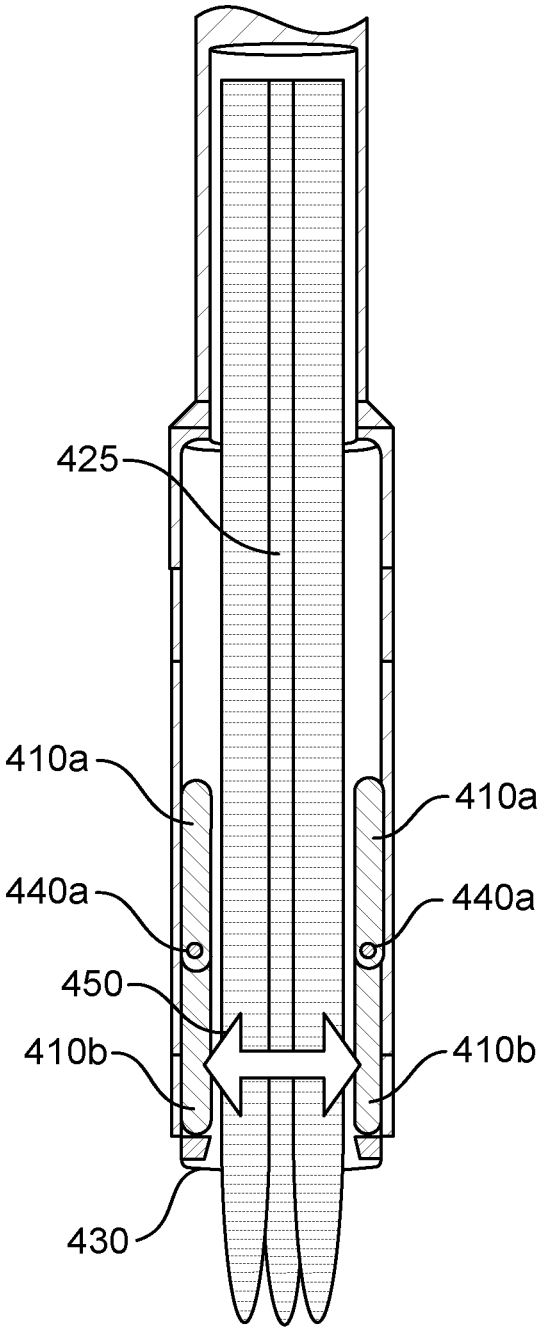

FIG. 4C illustrates the nozzle 405 and two mechanical rods 410*a, b* of FIG. 4B in accordance with one or more embodiments. The fluid 425 is now conveying through the nozzle bore 420 at a second flow rate, where the second flow rate is greater than the first flow rate. In response to the fluid 425 conveying at the second flow rate, the second mechanical rod 410*b* externally rotates relative to the first mechanical rod 410*a* until the second mechanical rod 410*b* contacts the surface of the nozzle bore 420 to further open or increase the nozzle aperture 430 as shown by the arrow 450. In other words, the fluid 425 is less restricted by the increased nozzle aperture 430. In turn, the fluid 425 conveying through the increased nozzle aperture 430 may create more turbulence around the drill bit 155 to thereby increase the rate of penetration of the drill bit 155 and more fluid circulation for better cleaning of the borehole 105.

Figure 5A:
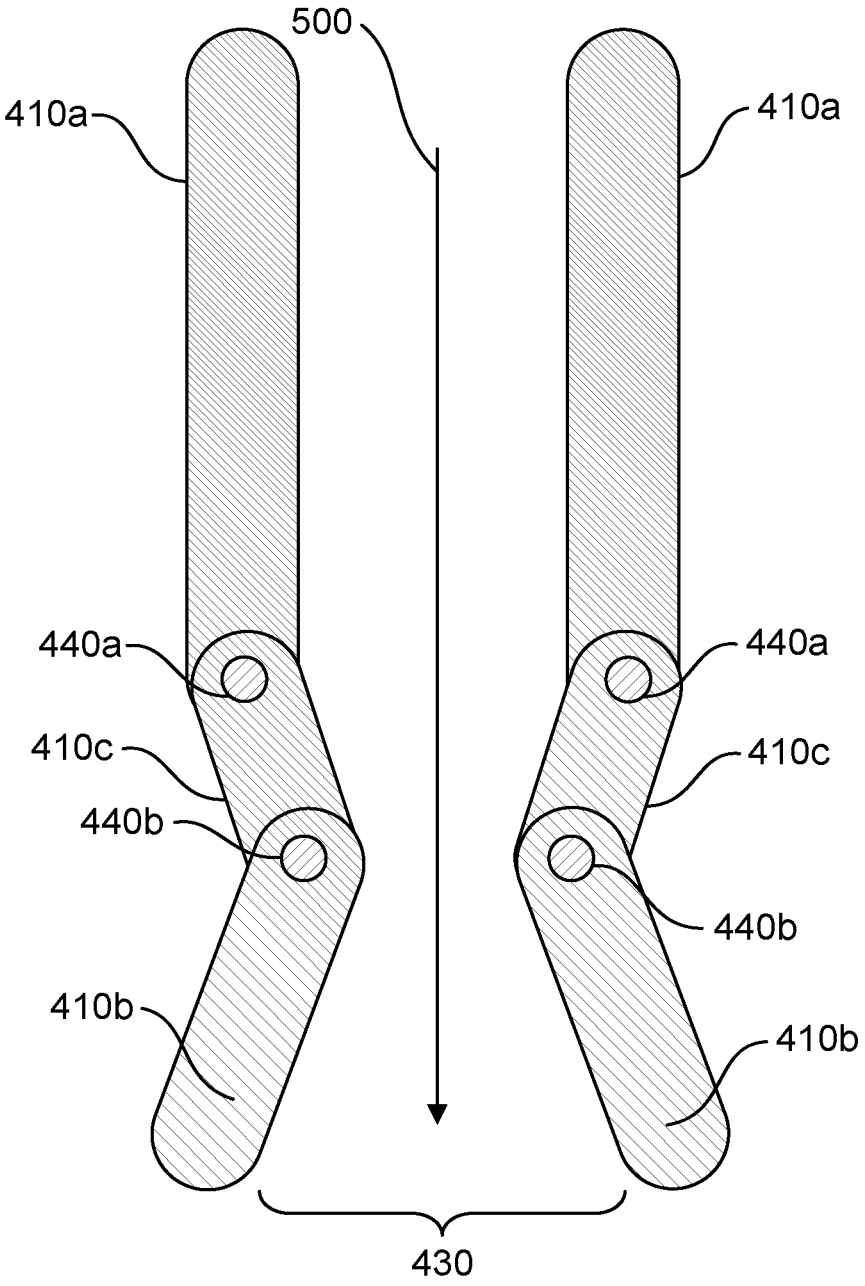
FIGS. 5A-5C illustrate mechanical rods in accordance with one or more embodiments.
Figure 5B:
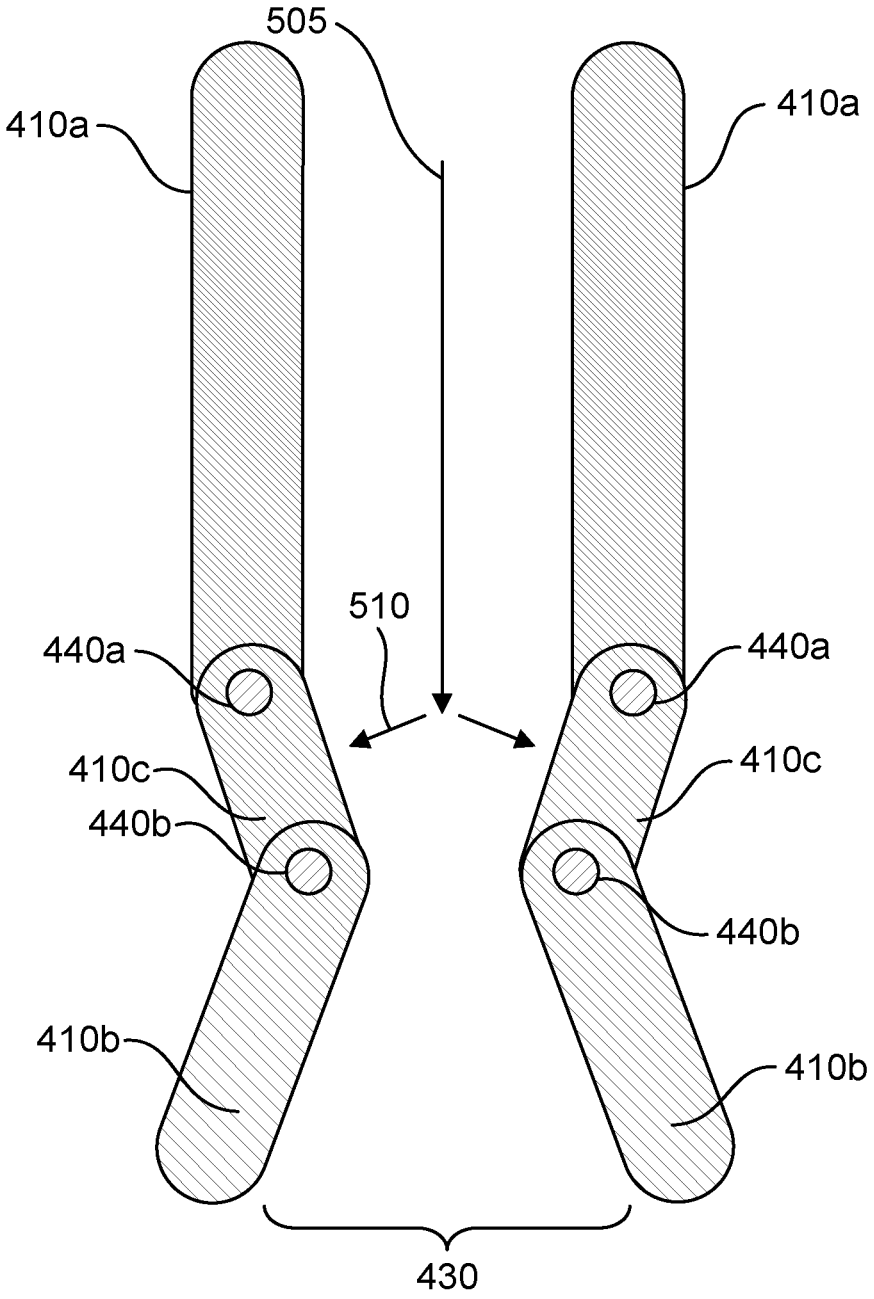
Figure 5C:
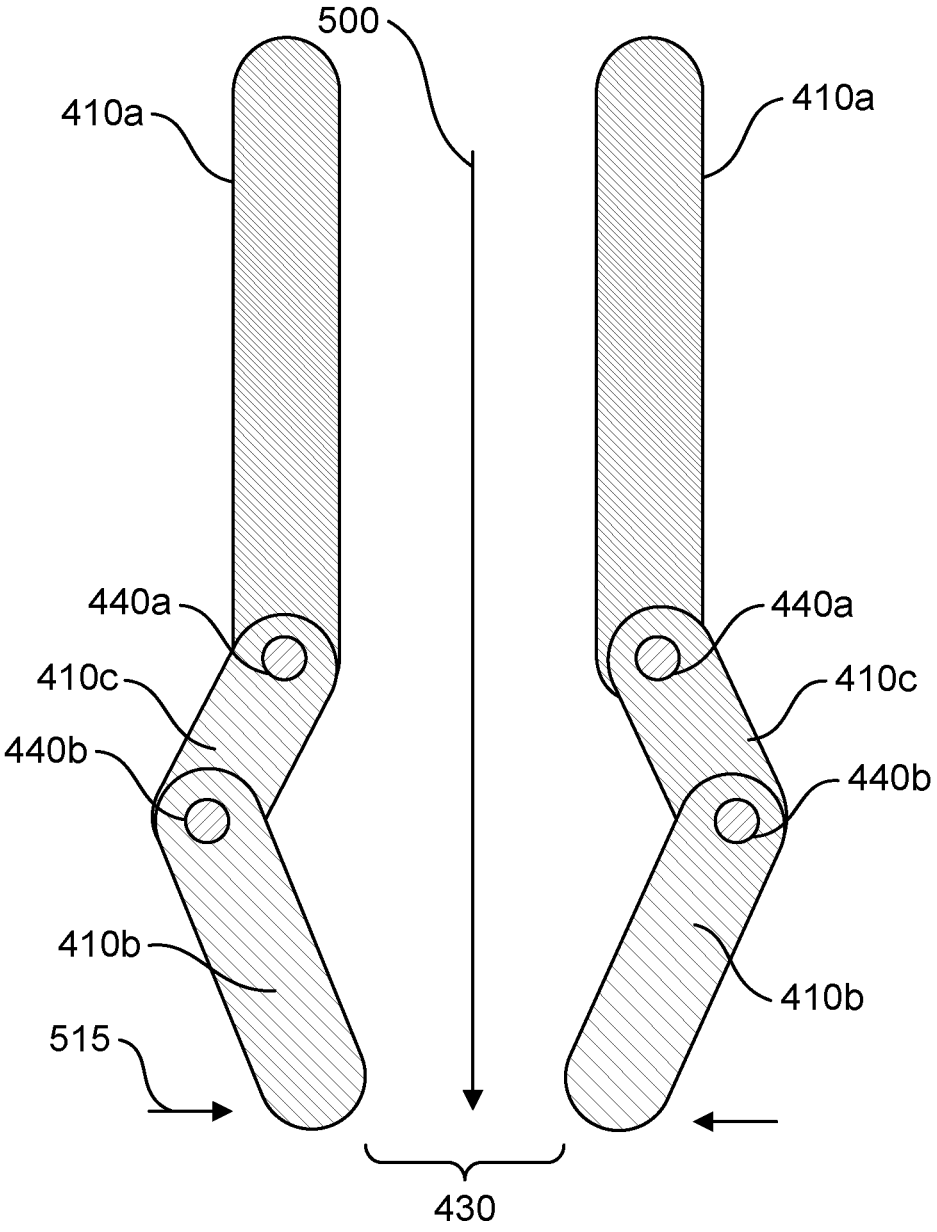

FIGS. 5A-5C illustrate three mechanical rods 410*a-c* and two hinges 440*a, b* in accordance with one or more embodiments. In these embodiments, the three mechanical rods 410*a-c* include a first mechanical rod 410*a*, second mechanical rod 410*c*, and third mechanical rod 410*b*. Further, the two hinges 440*a, b* include a first hinge 440*a* and second hinge 440*b*. The first mechanical rod 410*a* is fixed to the surface 435 of the nozzle bore 420, though not shown in FIGS. 5A-5C. The second mechanical rod 410*c* is connected to the first mechanical rod 410*a* longitudinally using the first hinge 440*a*. Accordingly, the second mechanical rod 410*c* is free to rotate around the first hinge 440*a*. The third mechanical rod 410*b* is connected to the second mechanical rod 410*c* longitudinally using the second hinge 440*b*. Accordingly, the third mechanical rod 410*b* is free to rotate around the second hinge 440*b*.

FIG. 5A illustrates fluid 425 conveying through the nozzle bore 420 at a first flow rate as shown by the arrow 500. In response to the fluid 425 conveying at the first flow rate, the second mechanical rod 410*c* internally rotates around the first hinge 440*a* relative to the first mechanical rod 410*a*. In response to the internal rotation of the second mechanical rod 410*c*, the third mechanical rod 410*b* externally rotates around the second hinge 440*b* relative to the second mechanical rod 410*c* to thereby open or increase the nozzle aperture 430. Accordingly, by design, when the second mechanical rod 410*c* rotates, the third mechanical rod 410*b* rotates in the opposite direction in response.

FIG. 5B illustrates the fluid 425 conveying through the nozzle bore 420 at a second flow rate as shown by the arrow 505, where the second flow rate is greater than the first flow rate. In response to the fluid 425 conveying at the second flow rate, the second mechanical rod 410*c* externally rotates as shown by the arrows 510. In response to the external rotation of the second mechanical rod 410*c*, the third mechanical rod 410*b* internally rotates as shown by the arrows 515 in FIG. 5C to thereby decrease the nozzle aperture 430. In other words, the fluid 425 is more restricted by the reduced nozzle aperture 430.

Though not illustrated in FIG. 5C, the third mechanical rod 410*b* may internally rotate to thereby completely close the nozzle aperture 430. This may occur when fluid 425 is not conveying through the nozzle bore 420. Furthermore, though also not illustrated, a spring mechanism may be integrated with each hinge 440*a, b* if it is desirable to rotate one or more mechanical rods 410*a-c* to a default configuration.

Figure 6:
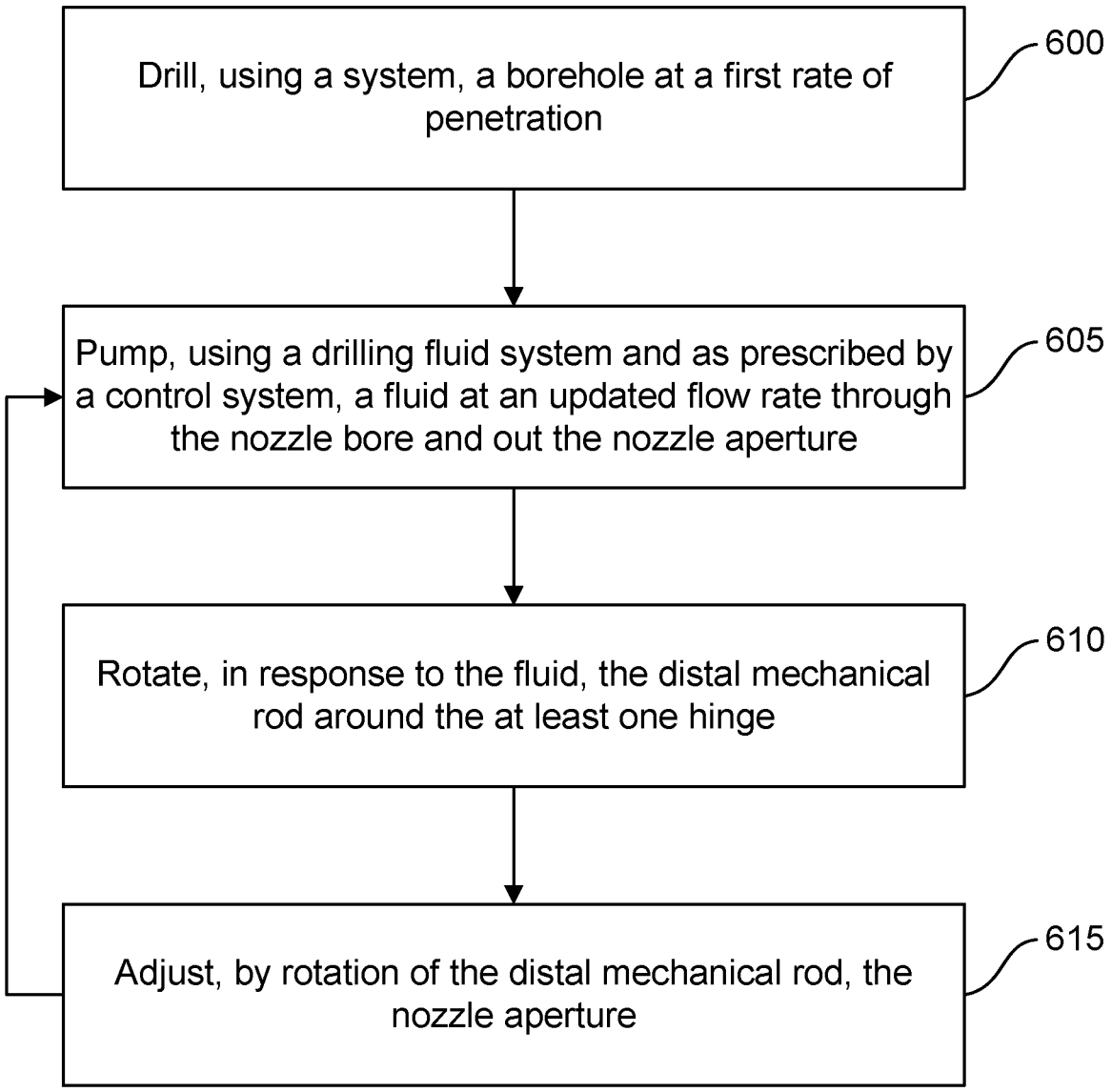
FIG. 6 shows a flowchart of a method in accordance with one or more embodiments.

FIG. 6 shows a flowchart of a method in accordance with one or more embodiments.

In step 600, a borehole 105 is drilled at a first rate of penetration using a system 400. The system 400 may include a drill bit 155, nozzle 405, at least two mechanical rods 410*a-c*, and at least one hinge 440*a, b*. The system 400 may be used within the greater drilling system 100 as described relative to FIG. 1.

In step 605, a fluid 425 is pumped or conveyed at an updated flow rate through the nozzle bore 420 and out the nozzle aperture 430. The fluid 425 is pumped using a drilling fluid system 175 and as prescribed by a control system 185 based on drilling parameters.

In step 610, in response to the fluid 425 conveying at the first flow rate, the last (i.e., furthest from borehole) mechanical rod 410*b* of the at least two mechanical rods 410*a-c* rotate around a last hinge 440*b*. Whether the last mechanical rod 410*b* externally or internally rotates depends on the number of mechanical rods 410*a-c* and the first flow rate relative to the previous flow rate.

In step 615, the nozzle aperture 430 adjusts in size by rotation of the last mechanical rod 410*b*. If the last mechanical rod 410*b* internally rotates, the nozzle aperture 430 decreases in size to thereby allow less or restrict the fluid 425 through the nozzle aperture 430. If the last mechanical rod 410*b* externally rotates, the nozzle aperture 430 increases in size to thereby allow more fluid 425 through the nozzle aperture 430.

The method may be repeated as the flow rate of the fluid 425. Accordingly, an increase in the flow rate of the fluid 425 over time may increase the rate of penetration of drilling. Furthermore, the flow of fluid 425 controls the size of the nozzle aperture 430 in real-time during drilling of the borehole 105 as drilling conditions change.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A system comprising:

a drill bit having a drill bit bore and configured to drill a borehole;

a nozzle disposed within the drill bit bore and having a nozzle bore configured to convey a fluid;

a first mechanical rod fixed to a surface of the nozzle bore;

a second mechanical rod disposed along the surface, wherein the second mechanical rod and the nozzle bore form a nozzle aperture; and a hinge configured to connect the first mechanical rod and the second mechanical rod together longitudinally, wherein the second mechanical rod is configured to rotate around the hinge in response to the fluid to adjust the nozzle aperture.

2. The system of claim 1, further comprising a drillstring disposed proximal to the drill bit and configured to convey the fluid.

3. The system of claim 1, further comprising a drilling fluid system configured to pump the fluid through the nozzle bore at a flow rate.

4. The system of claim 1, wherein a first flow rate of the fluid causes the second mechanical rod to rotate to decrease the nozzle aperture.

5. The system of claim 4, wherein a second flow rate of the fluid causes the second mechanical rod to rotate to increase the nozzle aperture, wherein the second flow rate is greater than the first flow rate.

6. The system of claim 1, wherein the hinge is configured to connect an end of the first mechanical rod to an end of the second mechanical rod.

7. A system comprising:

a drill bit having a drill bit bore and configured to drill a borehole;

a nozzle disposed within the drill bit bore and having a nozzle bore configured to convey a fluid;

a first mechanical rod fixed to a surface of the nozzle bore;

a second mechanical rod disposed along the surface;

a third mechanical rod disposed along the surface, wherein the third mechanical rod and the nozzle bore form a nozzle aperture; and two hinges configured to connect the first mechanical rod, the second mechanical rod, and the third mechanical rod together longitudinally, wherein the third mechanical rod is configured to rotate around the two hinges in response to the fluid to adjust the nozzle aperture.

8. The system of claim 7, wherein a first flow rate of the fluid causes the second mechanical rod to rotate.

9. The system of claim 8, wherein the third mechanical rod rotates in response to the second mechanical rod rotating to increase the nozzle aperture.

10. The system of claim 8, wherein a second flow rate of the fluid causes the second mechanical rod to rotate.

11. The system of claim 10, wherein the third mechanical rod rotates in response to the second mechanical rod rotating to decrease the nozzle aperture, wherein the second flow rate is greater than the first flow rate.

12. A method comprising:

drilling, using a system, a borehole at a first rate of penetration, the system comprising:

a drill bit having a drill bit bore, a nozzle disposed within the drill bit bore and having a nozzle bore, a first mechanical rod fixed to a surface of the nozzle bore;

a second mechanical rod disposed along the surface, wherein the second mechanical rod and the nozzle bore form a nozzle aperture, and at least one hinge configured to connect the first mechanical rod and the second mechanical rod together longitudinally;

pumping, using a drilling fluid system, a fluid at a first flow rate through the nozzle bore and out the nozzle aperture;

rotating, in response to the fluid, the second mechanical rod around the at least one hinge;

adjusting, by rotation of the second mechanical rod, the nozzle aperture.

13. The method of claim 12, wherein the first flow rate is prescribed based on drilling parameters.

14. The method of claim 12, further comprising:

pumping, using the drilling fluid system, the fluid at a second flow rate through the nozzle bore and out the adjusted nozzle aperture;

rerotating, in response to the fluid, the second mechanical rod; and readjusting, by rotation of the second mechanical rod, the nozzle aperture.

15. The method of claim 14, further comprising drilling, using the system, the borehole at a second rate of penetration.

16. The method of claim 14, wherein readjusting the nozzle aperture comprises increasing the nozzle aperture.

17. The method of claim 14, wherein the system further comprises a third mechanical rod disposed along the surface, and wherein readjusting the nozzle aperture comprises decreasing the nozzle aperture.

18. The method of claim 12, wherein adjusting the nozzle aperture comprises decreasing the nozzle aperture.

19. The method of claim 12, wherein the system further comprises a third mechanical rod disposed along the surface, and wherein adjusting the nozzle aperture comprises increasing the nozzle aperture.

* * * * *